US006648687B2

(12) United States Patent
Otto et al.

(10) Patent No.: US 6,648,687 B2
(45) Date of Patent: Nov. 18, 2003

(54) METHOD FOR MOUNTING A CONNECTOR ON A PRINTED CIRCUIT BOARD, AND SHIELDED CONNECTOR AND LOWER SHIELDING PLATE FOR USE IN SUCH A METHOD

(75) Inventors: Nadia Otto, Mechelen (BE); Marc Fret, Hoboken (BE); Hubert Booghmans, Meise-Wolvertem (BE); Werner Panis, Tessenderlo (BE)

(73) Assignee: Framatome Connectors International, Courbevoie (FR)

( * ) Notice: Subject to any disclaimer, the term of this patent is extended or adjusted under 35 U.S.C. 154(b) by 0 days.

(21) Appl. No.: 09/808,283

(22) Filed: Mar. 14, 2001

(65) Prior Publication Data

US 2001/0036769 A1 Nov. 1, 2001

(30) Foreign Application Priority Data

Mar. 15, 2000 (NL) ..... 1014646

(51) Int. Cl.[7] ..... H01R 43/648
(52) U.S. Cl. ..... 439/607
(58) Field of Search ..... 439/607, 609, 439/108, 101

(56) References Cited

U.S. PATENT DOCUMENTS 5,104,329 A 4/1992 Brown et al. ..... 439/108
5,259,773 A 11/1993 Champion et al. ..... 439/108
5,500,788 A 3/1996 Longueville et al. ..... 361/800
5,934,940 A * 8/1999 Maranto et al. ..... 439/607
5,934,941 A 8/1999 Hirai et al. ..... 439/607
6,095,830 A * 8/2000 Hirata et al. ..... 439/607
6,250,964 B1 * 6/2001 Fair et al. ..... 439/607

FOREIGN PATENT DOCUMENTS

DE 19640847 A1 4/1998
EP 0893854 A2 1/1999

* cited by examiner

*Primary Examiner*—Renee Luebke
*Assistant Examiner*—Felix D. Figueroa
(74) *Attorney, Agent, or Firm*—Perman & Green, LLP

(57) ABSTRACT

A shielded connector comprises a housing of insulating material accommodating a plurality of contact elements, and a shielding plate comprising a front half and a back half. The front half has a plurality of contact portions and the back half has contact ends for connection to a printed circuit board. The housing is provided with at least one channel at a front end thereof, this at least one channel being open at its back end and closed at its front end for receiving the front end of the shielding plate. The shielding plate is provided with a bend near its front end for cooperation with back end of the channel. The connector is mounted on a printed circuit board and then the shielding plate is mounted on the printed circuit board by first inserting the front end of the lower shielding plate into the at least one channel until the contact ends are at least substantially aligned with the through holes of the printed circuit board and thereafter inserting the contact ends into the through holes of the printed circuit board.

10 Claims, 7 Drawing Sheets

METHOD FOR MOUNTING A CONNECTOR ON A PRINTED CIRCUIT BOARD, AND SHIELDED CONNECTOR AND LOWER SHIELDING PLATE FOR USE IN SUCH A METHOD

BACKGROUND OF THE INVENTION

1. Field of the Invention

The invention relates to a method for mounting a connector on a printed circuit board comprising the steps of providing a connector having a housing of insulating material with a plurality of contact elements, providing a printed circuit board having a plurality of through holes mounting the connector on the printed circuit board, providing a shielding plate having contact ends at a back end and contact portions near a front end, and mounting the shielding plate on the printed circuit board by inserting the contact ends into through holes of the printed circuit board. The invention also relates to a shielded connector and shielding plate, the connector comprising a housing of insulating material accommodating a plurality of contact elements, and the shielding plate comprising a front half and a back half, the front half having a plurality of contact portions and the back half having contact ends for connection to a printed circuit board. The invention further relates to a shielded connector comprising a housing of insulating material accommodating a plurality of contact elements. The invention still further relates to a shielding plate comprising a front half and a back half, in the front half having a plurality of contact portions and the back half having contact ends for connection to a printed circuit board.

2. Description of Prior Developments

A method of this type is disclosed in U.S. Pat. No. 5,259,773. In this known method the lower shielding plate is mounted on the lower side of the printed circuit board by moving the complete plate mainly perpendicular to the lower side of the a printed circuit board. During this movement the contact ends are inserted into through holes of the printed circuit board, while an end edge of the plate engages the front end edge of the printed circuit board. This requires an accurate manufacturing of the lower shielding plate as the distance between the end edge and the contact ends should be the same as the distance between the front end of the printed circuit board and the through holes. Moreover, the front end of the connector housing is not covered by the lower shielding plate.

SUMMARY OF THE INVENTION

The invention aims to provide an improved method of the above-mentioned type and a shielded connector and lower shielding plate for use in such a method.

To this end the method of the invention is characterized by a housing that is provided having at least one channel at a front end portion thereof, the channel being closed at its front end and open at its back end, and further within a shielding plate that is mounted on the printed circuit board by first inserting its front end into the at least one channel until the contact ends are at least substantially aligned with the through holes of the printed circuit board and thereafter inserting the contact ends into the through holes of the printed circuit board.

In this manner the front end of the lower shielding plate can be received with play in the at least one channel at the front end of the housing, wherein any tolerances can be absorbed by the channel. Moreover, also the front end of the housing is mainly covered by the lower shielding plate.

In a preferred embodiment the shielding plate is provided with a bend near its front end, wherein the front end of the shielding plate is inserted into said at least one channel until the bend meets the back end of the channel, wherein the bend is located such that the contact ends will be aligned with the through holes of the printed circuit board when the bend is located at the back end of the channel. In this manner the mounting of the lower shielding plate is simplified.

In a further preferred embodiment the shielding plate is provided with an inclined intermediate part between a front half and a back half of the shielding plate, wherein the back half is pressed towards the printed circuit board during inserting the contact ends into the through holes, wherein by the inserting step the inclined part is at least partially flattened to thereby push the front end of the shielding plate further into said at least one channel and to bring the contact portions in position. In this manner mounting of the lower shielding plate is relatively simple, wherein by inserting the contact ends into the through holes the front end is automatically pushed further into the at least one channel of the housing.

The shielded connector and lower shielding plate of the invention are characterized in that the housing is provided with at least one channel at a front end thereof, said at least one channel being open at its back end and closed at its front end for receiving the front end of a shielding plate, and in that the shielding plate is provided with a bend near its front end for co-operation with a housing part of a connector.

BRIEF DESCRIPTION OF THE DRAWINGS

The invention will be further explained by reference to the drawings in which an embodiment of the shielded connector and shielding plate of the invention are schematically shown and moreover some steps of the method of the invention are shown for explanation.

DESCRIPTION OF THE PREFERRED EMBODIMENTS

Figure 1:
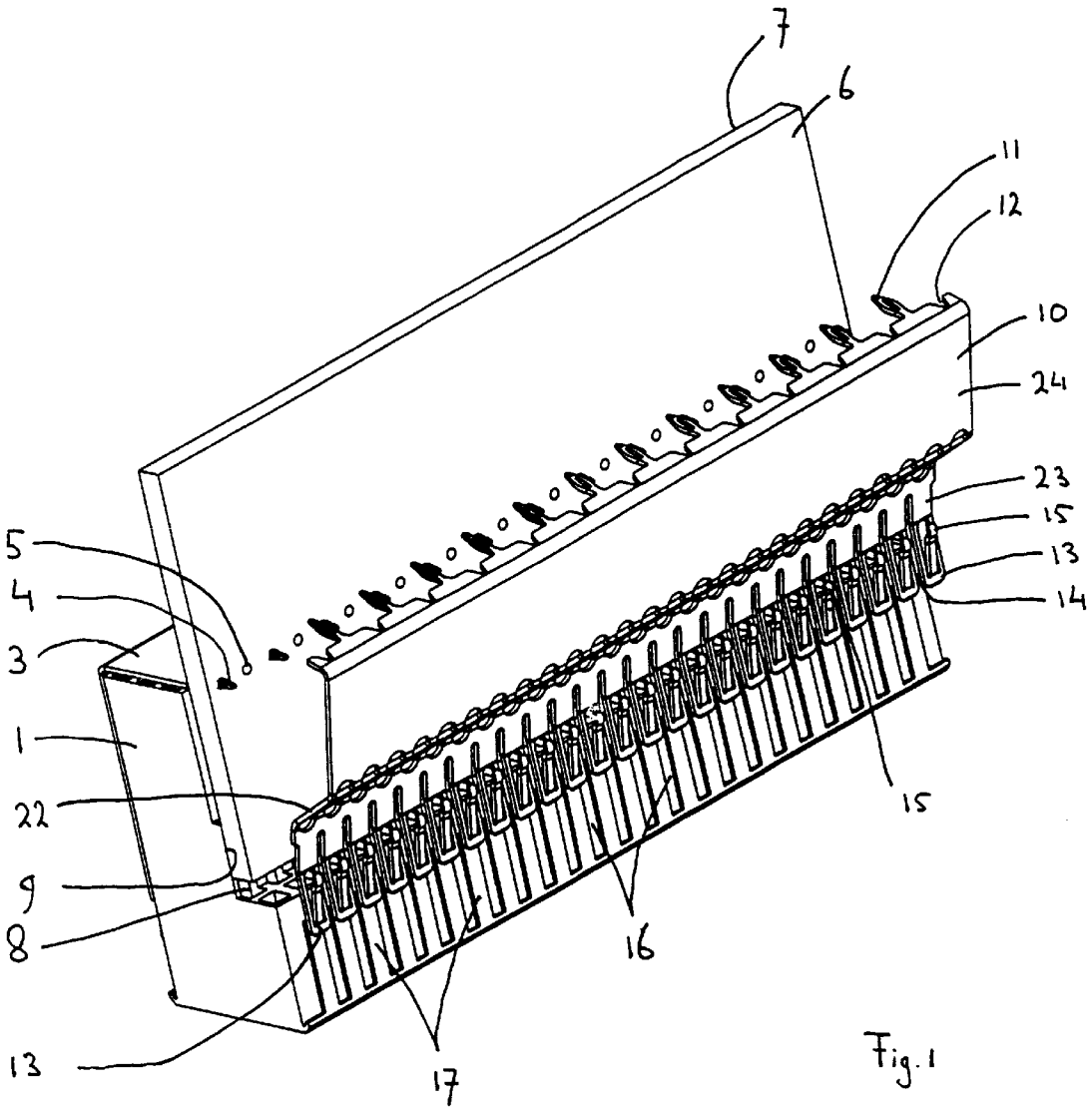
FIG. 1 is a perspective view of an embodiment of the shielded connector of the invention as mounted on a printed circuit board together with an embodiment of the shielding plate before mounting the same.

FIG. 1 shows a perspective view of a shielded connector comprising a housing 1 of insulating material accommodating a plurality of contact elements 2, of which only the contact ends projecting out of the housing can be seen in FIGS. 4–7. The connector further comprises an upper shielding plate 3 covering an upper side and a backside of the housing. The upper shielding plate 3 is provided with a plurality of contact ends 4 inserted in through holes 5 of a printed circuit board 6 just as the contact ends of the contact elements 2 (not shown in FIG. 1). The shielded connector is mounted on the printed circuit board 6 by inserting the contact ends of the contact elements 2 and the contact ends 4 of the upper shielding plate 3 into the through holes 5 in a usual manner. The upper side 7 of the printed circuit board 6 is received in a recess 8 of the housing 1 against a lower side 9 of the housing.

FIG. 1 further shows a lower shielding plate 10 having contact ends 11 at a back end, which contact ends 11 are an integral part of the lower shielding plate 10. As will be explained hereinafter, the contact ends 11 are inserted into through holes 5 of the same row of through holes as the contact ends 4 of the upper shielding plate 3, wherein recesses 12 are provided between the contact ends 11 for receiving the contact ends 4 projecting through the through holes 5.

As clearly shown in FIG. 1, the lower shielding plate 10 is provided with a plurality of shielding fingers 13 at its front end, the shielding fingers 13 being separated by slots 14. Each shielding finger 13 is provided with a contact spring 15 projecting outwardly with respect to the shielding fingers 13. These contact springs 15 operate as contact portions near the front end of the shielding plate 10.

The lower side 9 of the housing 1 is provided with a plurality of channels 16 at its front end to receive the shielding fingers 13. The channels 16 are separated by ribs 17 having a T-shaped cross section as can be seen in particular in FIG. 2. In this manner, the T-shaped ribs 17 provide head parts 18 engaging side edges of the shielding fingers 13. Slots 19 between the head parts 18 of the T-shaped ribs 17 receive the contact springs 15 (FIG. 4) so that these contact springs 15 can co-operate with corresponding contact portions of a complementary connector.

The channels 16 are closed at their front ends by a front wall 20 having an L-shaped cross section, the free end of which engages around the corresponding shielding finger 13. The channels 16 are open at their back end to allow insertion of the shielding fingers 13.

Figure 2:
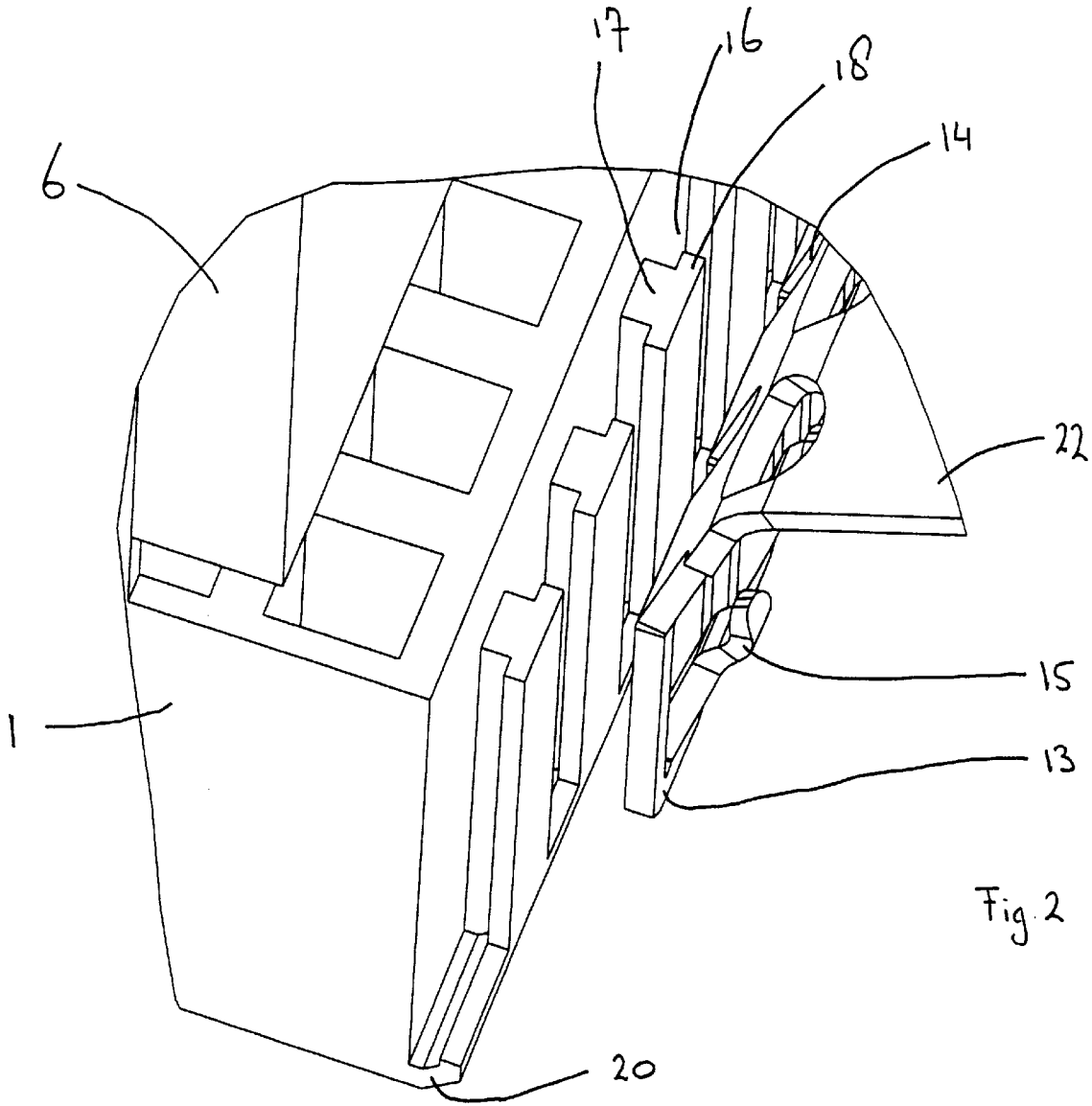
FIG. 2 shows a detail of the connector and shielding plate of FIG. 1 at a larger scale.
Figure 3:
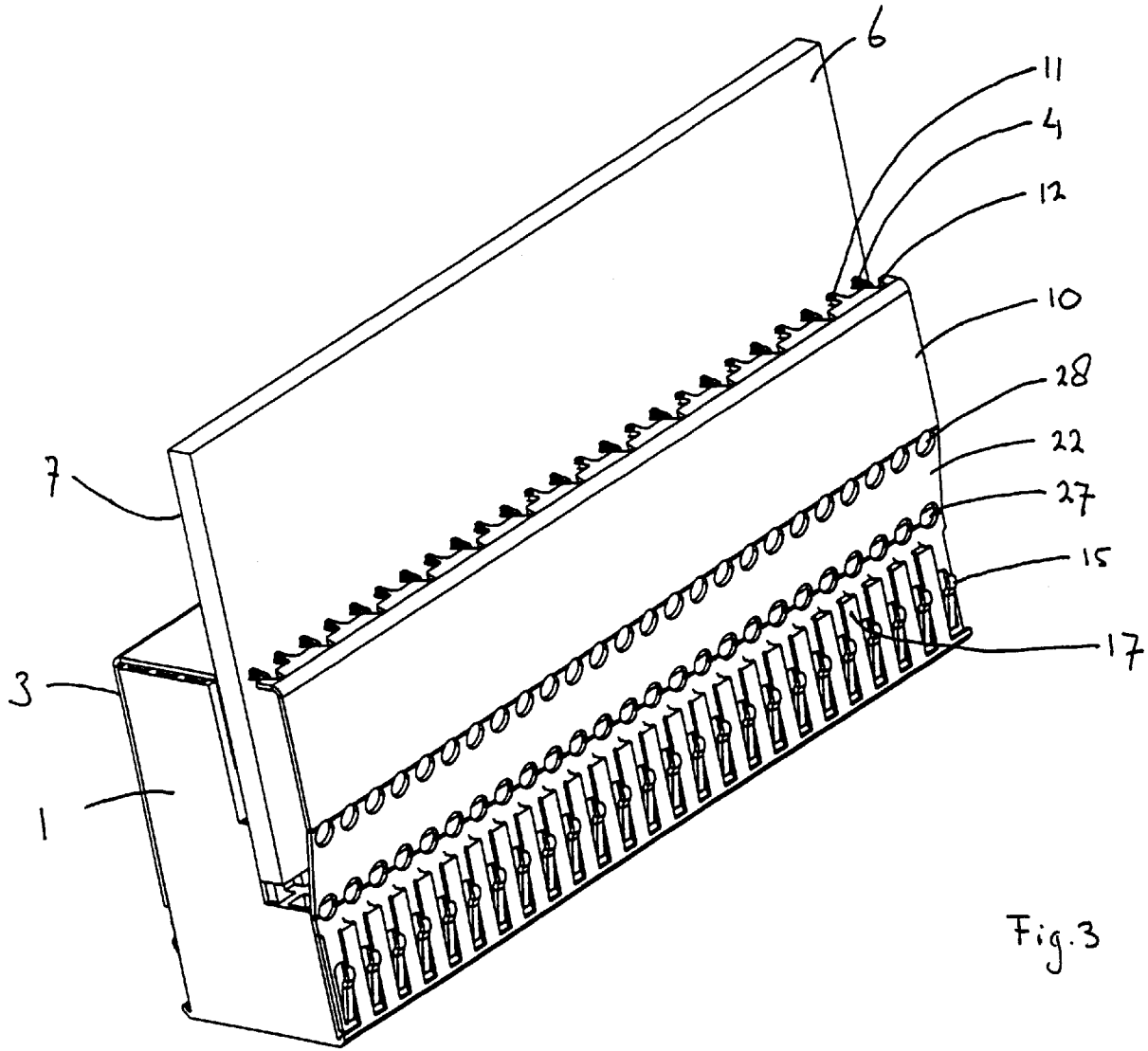
FIG. 3 is a perspective view of the connector and shielding plate of FIG. 1 after mounting the shielding plate.
Figure 4:
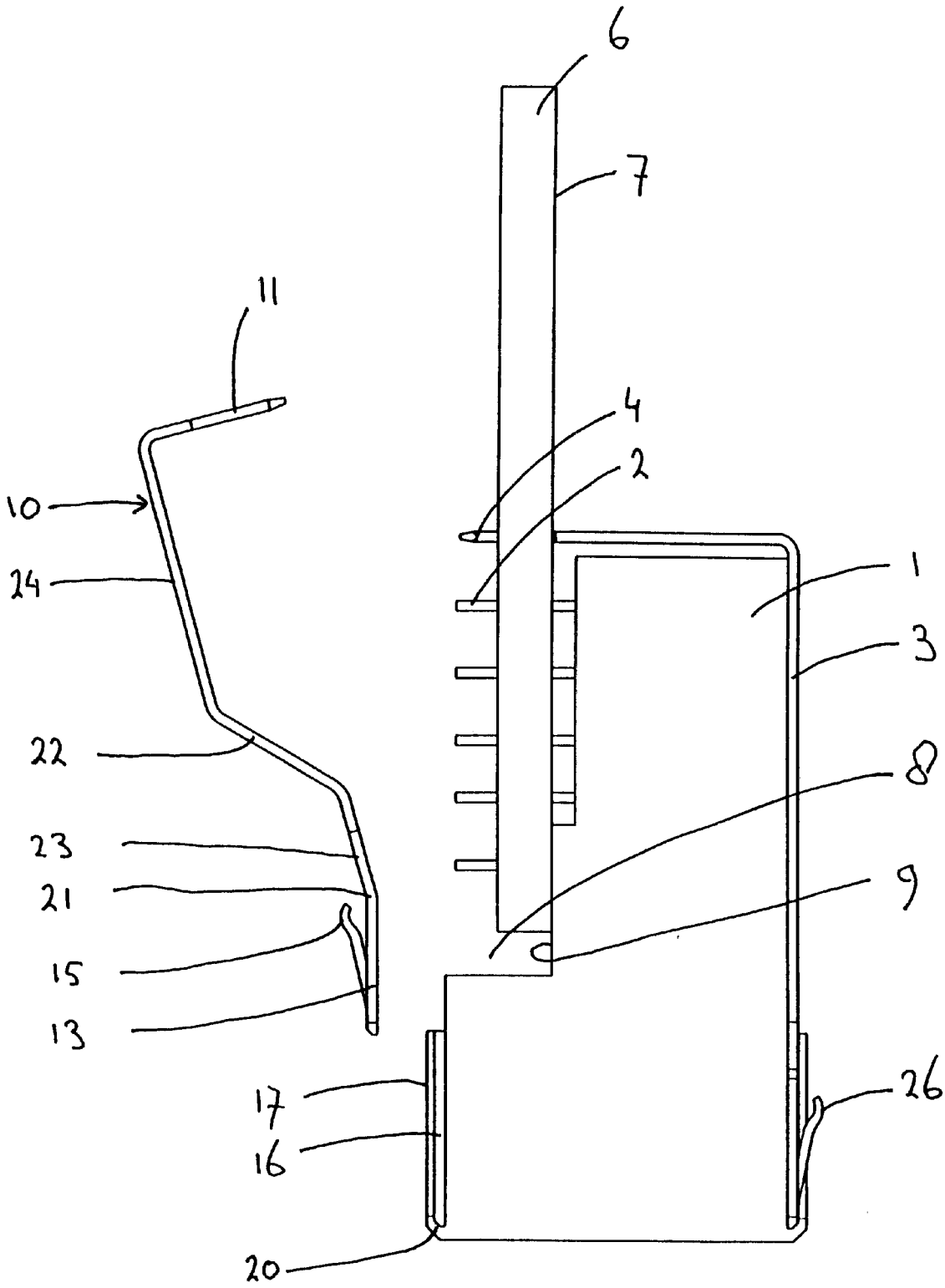
FIGS. 4–7 show four steps of an embodiment of the method of the invention.
Figure 5:
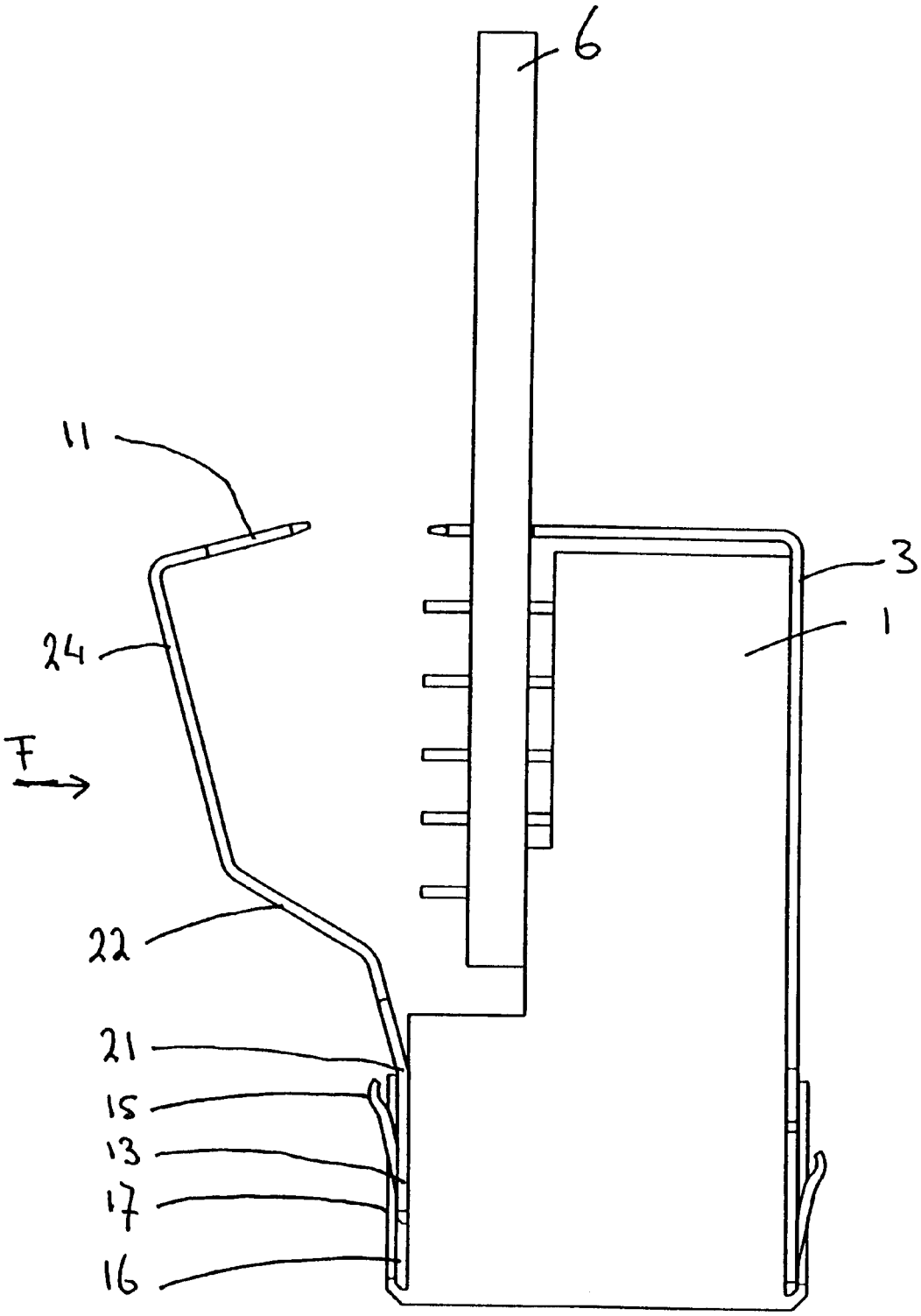
Figure 6:
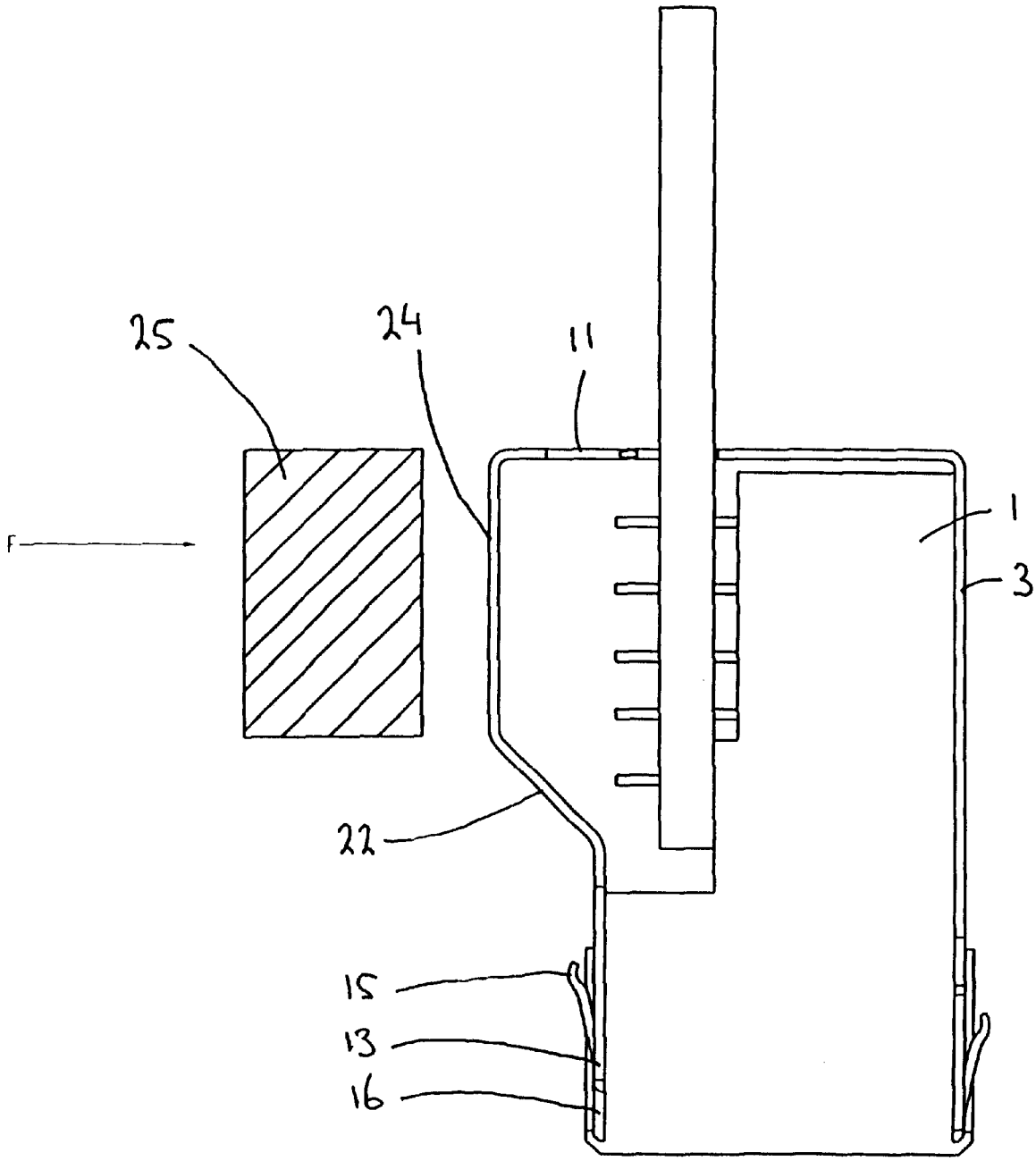

As can be seen in the drawings, in particular in FIGS. 2, 4 and 5, the lower shielding plate 10 is provided with a bend 21 near its front end, the function of which will be discussed hereinafter. Further, the lower shielding plate 10 comprises an inclined intermediate part 22 between a front half 23 and a back half 24 of the plate 10.

For mounting the lower shielding plate 10, the shielding fingers 13 are inserted into the channels 16 until the bend 21 meets the back ends of the channels 16, i.e. the back ends of the ribs 17. The bend 21 is located such that when the bend 21 meets the back ends of the ribs 17, the contact ends 11 of the lower shielding plate are aligned with the through holes 5. The first steps of the method for mounting the lower shielding plate 10 are shown in FIGS. 4 and 5, wherein FIG. 5 shows the lower shielding plate 10 with the bend 21 contacting the back ends of the ribs 17. By exerting a force as indicated by an arrow F, the lower shielding plate 10 is rotated towards the printed circuit board 6, wherein the contact ends 11 are introduced into the through holes 5.

Figure 7:
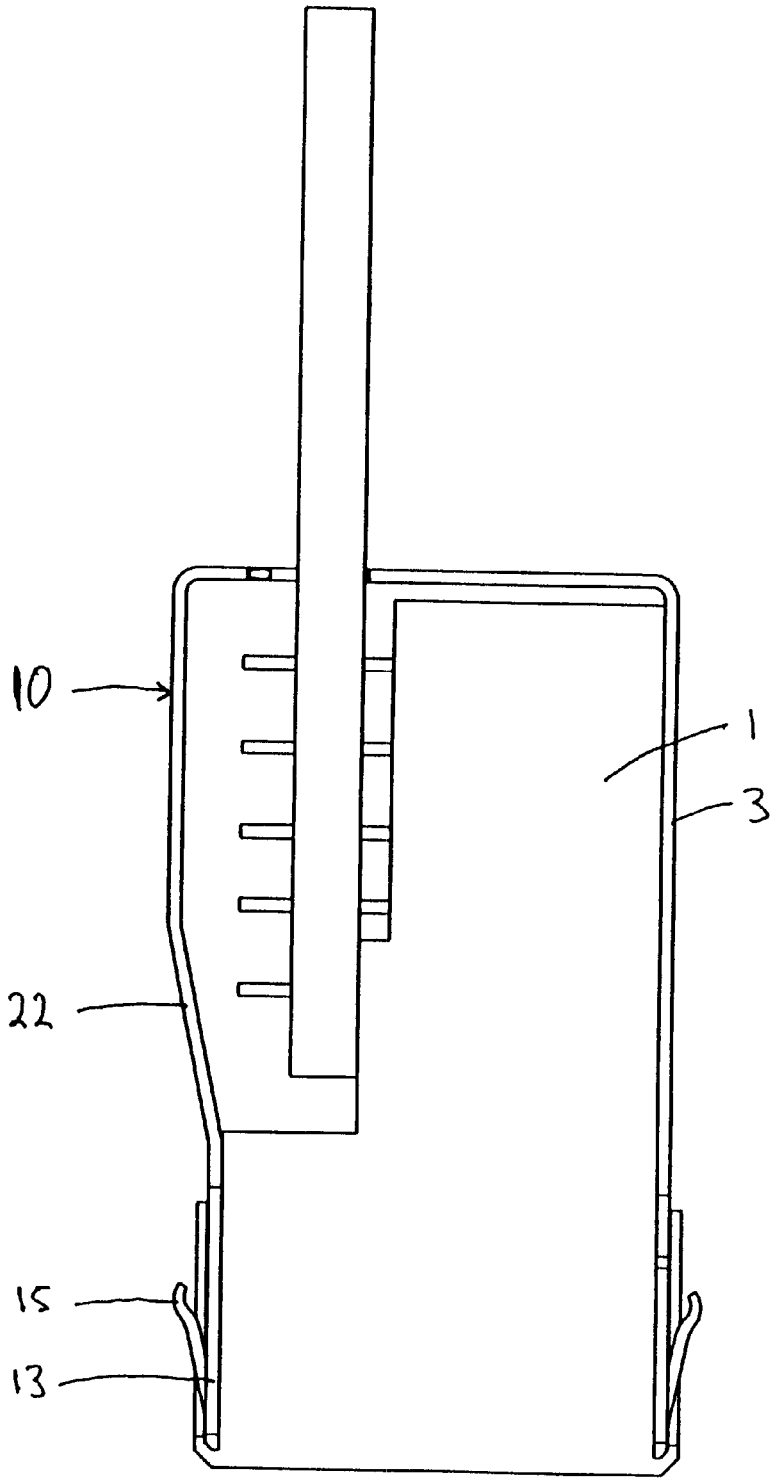

By means of a schematically indicated single tool 25 (FIG. 6), a force is exerted on the back half 24 of the lower shielding plate thereby inserting the contact ends 11 further into the through holes 5 and flattening the intermediate part 22, so that the shielding fingers 13 are further slid into the channels 16. The end position of the lower shielding plate 10 with the shielding fingers 13 fully introduced into the channels 16 is shown in FIG. 7, in which end position the contact springs 15 of the lower shielding plate 10 are substantially at the same height as contact springs 26 of the upper shielding plate 3.

The method described for mounting the shielded connector together with the lower shielding plate 10 shows the advantage that any tolerances can be absorbed in the channels 16 of the housing 1. Positioning the contact ends 11 in alignment with the through holes 5 is relatively simple by providing the bend 21 in the lower shielding plate 10. The tooling for mounting the lower shielding plate 10 is relatively simple as a single tool 25 can be used for inserting the contact ends 11 into the through holes 5 and by the same operation for further inserting the shielding fingers 13 into the channels 16.

It is noted that to prevent damage to the housing 1 during flattening the intermediate part 22, holes 27, 28 are provided at the transitions of the intermediate part 22 and the front half 23 and back half 24, respectively. By weakening the transitions in this manner it is guaranteed that the lower shielding plate will be deformed at these transitions. As the contact springs 15 are carried by independent shielding fingers 13, a favourable spring operation of the contact springs 15 is guaranteed. However, it is not strictly necessary to provide an independent shielding finger for each contact spring 15. To apply the invention, the front end of the housing 1 should have at least one channel for receiving the front end with contact springs 15 of the lower shielding plate 10. Further, the mounting of the lower shielding plate 10 by first inserting the front end into the channels from the back side and thereafter inserting the contact ends is also possible with a shielding plate without inclined intermediate part. An embodiment with inclined intermediate part is however preferred.

The invention is not restricted to the above-described embodiment which can be varied in a number of ways within the scope of the following claims.

What is claimed is:

1. A method for mounting a connector on a printed circuit board, comprising:

(a) providing a connector having a housing of insulating material with a plurality of contact elements;

(b) providing a printed circuit board having a plurality of through holes;

(c) mounting the connector on the printed circuit board;

(d) providing a shielding plate having contact ends at a back end and contact portions near a front end; and (e) mounting the shielding plate on the printed circuit board by inserting the contact ends into through holes of the printed circuit board, wherein the housing is provided having at least one channel at a front end portion thereof, the channel being closed at a front end and open at a back end, and further wherein the shielding plate is mounted on the printed circuit board by first inserting its front end into the at least one channel until the contact ends are at least substantially aligned with the through holes of the printed circuit board and thereafter inserting the contact ends into the through holes of the printed circuit board, the front end of the housing being substantially covered by a portion of the shielding plate, the shielding plate being provided with a bend near its front end wherein the front end of the shielding plate is inserted into the at least one channel until the bend meets the back end of the channel, wherein the bend is located such that the contact ends will be aligned with the through holes of the printed circuit board when the bend is located at the back end of the channel and when a force is exerted on a back half of the shielding plate the bend is deformed where it contacts the back end of the channel to allow the front end of the shielding plate to slide further into the channel towards the front end of the channel and the contact ends to be inserted into the through holes.

2. A method according to claim 1, wherein said shielding plate is provided with an inclined intermediate part between a front halt and a back half of said shielding plate, wherein the back half is pressed towards said printed circuit board during an inserting of the contact ends into said through holes, further wherein when the contact ends are inserted into the through holes the inclined part is at least partially flattened to thereby push said front end of said shielding plate further into said at least one channel and to bring said contacts in position.

3. A method according to claim 1, wherein said housing at its front end is provided with a series of adjacent channels separated by ribs with a T-shaped cross section, the ribs having heads wherein the front end of said shielding plate is provided with a series of fingers separated by slots, each finger having a contact spring, the method further including a step of mounting said shielding plate and wherein during the step of mounting the shielding plate the fingers are inserted into said channels, further wherein side edges of the fingers are received below heads of T-shaped ribs and the contact springs are received in slots between the heads of the T-shaped ribs.

4. The method of claim 1 wherein the step of exerting a force on the back half of the shielding plate further comprises flattening an intermediate part of the shielding plate.

5. The method of claim 4 wherein the intermediate part is located between a front half of the shielding plate and the back halt and each transition area between the front half and the intermediate part and the back half and the intermediate part includes at least one opening allowing each transition area to deform during flattening of the intermediate part.

6. A shielded connector and shielding plate, the connector comprising a housing of insulating material accommodating a plurality of contact elements the housing having a front end and a back end, and shielding plate comprising a front half and a back half, the front halt having a plurality of contact portions and the back half having contact ends for connection to a printed circuit board, wherein the housing is provided with at least one channel at a front end thereof, the at least one channel being open at a back end and closed at a front end for receiving a front end of the shielding plate, and further in that the shielding plate is provided with a bend near the front end adapted to cooperate with a back end of the channel, wherein the bend is located such that the contact ends will be aligned with through holes of the printed circuit board when the bend is located at the back end of the channel, the connector further comprising an intermediate portion between the front half and the back half adapted to flatten when a force is exerted on the back half, and a transition portion between the front half and the intermediate portion and between the back half and the intermediate portion, each transition portion including at least one opening adapted to allow each transition portion to deform during flattening of the intermediate portion and allow the contact ends to be inserted into the through holes and the front end of the shielding plate to move further in the at least one channel toward the front end of the channel.

7. A shielded connector and shielding plate according to claim 6, wherein said front end of said housing is provided with a series of adjacent channels separated by ribs having a T-shaped cross section, wherein said front end of said shielding plate is provided with a series of fingers separated by slots having a width, each finger having a contact spring each contact spring having a width wherein the fingers are adapted to be received in said channels, further wherein the T-shaped ribs include heads that are adapted to engage side edges of the fingers, wherein the width of the contact springs is less than the width of the slots between the heads of the T-shaped ribs.

8. A shielded connector, comprising a housing of insulating material accommodating a plurality of contact elements, the housing having a front end and a back end, wherein the housing is provided with at least one channel at a front end thereof, said at least one channel being open at a back end and of each channel closed at a front end of each channel for receiving a front end of a shielding plate, the shielding plate further comprising a front end and a back end and an intermediate portion therebetween and a transition area between each of the front end and intermediate portion and the back end and intermediate portion, each transition area including an opening adapted to allow each transition area to deform when a force is exerted on the back end of the shielding plate and wherein the intermediate portion is flattened to allow the positioning of the contact elements into through holes of a printed circuit board and allowing the front end of the shielding plate to move towards the front end of the channel and the contact elements to align with the through holes.

9. A shielded connector according to claim 8, wherein said at least one channel is provided with a front wall having an L-shaped cross section and adapted to engage the front end of said shielding plate.

10. A shielded connector according to claim 8, wherein said front end of said housing is provided with a series of adjacent channels separated by ribs having a T-shaped cross section.

* * * * *